US009478925B2

(12) United States Patent
Wu et al.

(10) Patent No.: US 9,478,925 B2
(45) Date of Patent: Oct. 25, 2016

(54) CABLE CONNECTOR ASSEMBLY AND METHOD FOR MAKING THE SAME

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/971,976

(22) Filed: Dec. 16, 2015

(65) Prior Publication Data

US 2016/0172804 A1 Jun. 16, 2016

(30) Foreign Application Priority Data

Dec. 16, 2014 (CN) ..... 2014 1 0774290

(51) Int. Cl.

| | |
|---|---|
| ***H01R 24/00*** | (2011.01) |
| ***H01R 24/60*** | (2011.01) |
| ***H01R 43/02*** | (2006.01) |
| *H01R 107/00* | (2006.01) |
| *H01R 13/6597* | (2011.01) |

(52) U.S. Cl.

CPC ..... *H01R 24/60* (2013.01); *H01R 43/0249* (2013.01); *H01R 13/6597* (2013.01); *H01R 2107/00* (2013.01)

(58) Field of Classification Search

CPC ..... H01R 24/60; H01R 2107/00; H01R 13/6597; H01R 43/0249; H01R 13/516; H01R 13/6658; H01R 13/5804; H01R 13/6271

See application file for complete search history.

(56) References Cited

U.S. PATENT DOCUMENTS

| | | | | |
|---|---|---|---|---|
| 8,011,937 | B2 * | 9/2011 | Oddsen | H01R 25/006 439/107 |
| 8,167,661 | B2 * | 5/2012 | Straka | H01R 13/516 439/676 |
| 9,397,455 | B2 * | 7/2016 | Fontaine | H01R 4/2404 |
| 9,419,391 | B2 * | 8/2016 | Bolouri-Saransar | H01R 24/64 |
| 2006/0183380 | A1 * | 8/2006 | Tsai | H01R 13/5804 439/676 |
| 2009/0117784 | A1 * | 5/2009 | Wu | H01R 24/62 439/660 |
| 2009/0163084 | A1 * | 6/2009 | Straka | H01R 13/6658 439/676 |
| 2011/0124238 | A1 * | 5/2011 | Zhou | H01R 9/032 439/676 |
| 2011/0256764 | A1 * | 10/2011 | Wu | H01R 12/598 439/607.01 |
| 2015/0044907 | A1 * | 2/2015 | Kuang | H01R 9/038 439/607.22 |
| 2015/0214680 | A1 * | 7/2015 | Wu | H01R 13/6271 439/345 |
| 2015/0318646 | A1 * | 11/2015 | Little | H01R 4/023 439/78 |

FOREIGN PATENT DOCUMENTS

CN 202231277 U 5/2012

* cited by examiner

*Primary Examiner* — Jean F Duverne
(74) *Attorney, Agent, or Firm* — Wei Te Chung; Ming Chieh Chang

(57) ABSTRACT

A cable connector assembly includes a plug portion, a cable electrically connected with the plug portion and an insulative shell covering a part of the plug portion and the cable. The plug portion defines an insulative housing and a plurality of conductive terminals received in the insulative housing and arranged in two rows spaced apart from each other in a vertical direction, the conductive terminals including a plurality of detecting terminals, a plurality of signal terminals and a plurality of first terminals. The cable has a plurality of core wires. The plug portion further includes a connecting member for the first terminals shorted, the connecting member makes the first terminals shorted together so as to the first terminals are just soldered with a core wire of the cable.

12 Claims, 13 Drawing Sheets

CABLE CONNECTOR ASSEMBLY AND METHOD FOR MAKING THE SAME

BACKGROUND OF THE INVENTION

1. Field of the Invention

The present invention relates to a cable connector assembly and method for making the same, and more particularly to a cable connector assembly with a plurality of improved conductive terminals and method for making the same.

2. Description of the Related Art

Chinese Patent No. 202231277U issued on May 23, 2012, discloses a cable connector assembly including an insulative housing having a plurality of receiving slots, a plurality of terminals retained in the receiving slots of the insulative housing and a connecting member. The terminals include at least a pair of shorting terminals which are not connected with the cable. The connecting member is electrically connected to the pair of shorting terminals and includes a first arm, a second arm and a connecting arm connected with the first and second arms. The first arm and the second arm are received in the receiving spaces between the shorting terminals and the arms of the receiving slots adjacent to the shorting terminals. However, the connection between the terminals of the cable connector is only used for a reserved function, the terminals are not connected with the cables transmission signal or power. And the connecting member is disposed outside of the insulative housing, thus easy to fall off and can not be achieved shorting function.

Therefore, an improved cable connector assembly is highly desired to meet overcome the requirement.

BRIEF SUMMARY OF THE INVENTION

An object of the present invention is to provide a cable connector assembly with a plurality of improved conductive terminals which can reduce the number of welding between the wires and the conductive terminals.

In order to achieve above-mentioned object, a cable connector assembly includes a plug portion, a cable electrically connected with the plug portion and an insulative shell covering a part of the plug portion and the cable. The plug portion defines an insulative housing and a plurality of conductive terminals received in the insulative housing and arranged in two rows spaced apart from each other in a vertical direction, the conductive terminals including a plurality of detecting terminals, a plurality of signal terminals and a plurality of first terminals. The cable has a plurality of core wires. The plug portion further includes a connecting member for the first terminals shorted, the connecting member makes the first terminals shorted together so as to the first terminals are just soldered with a core wire of the cable.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
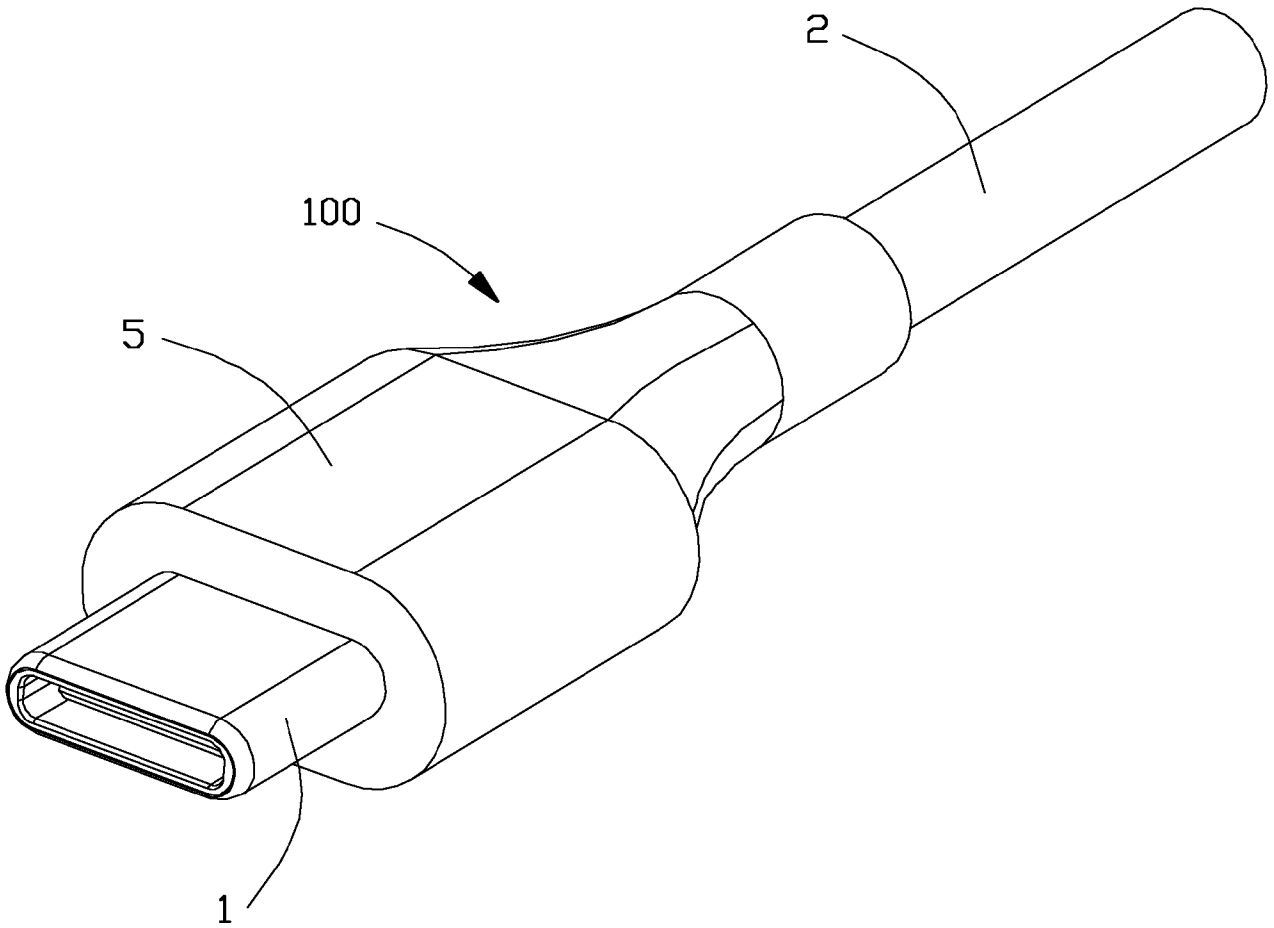
FIG. 1 is a perspective view showing a cable connector assembly in accordance with the present invention.
Figure 5:
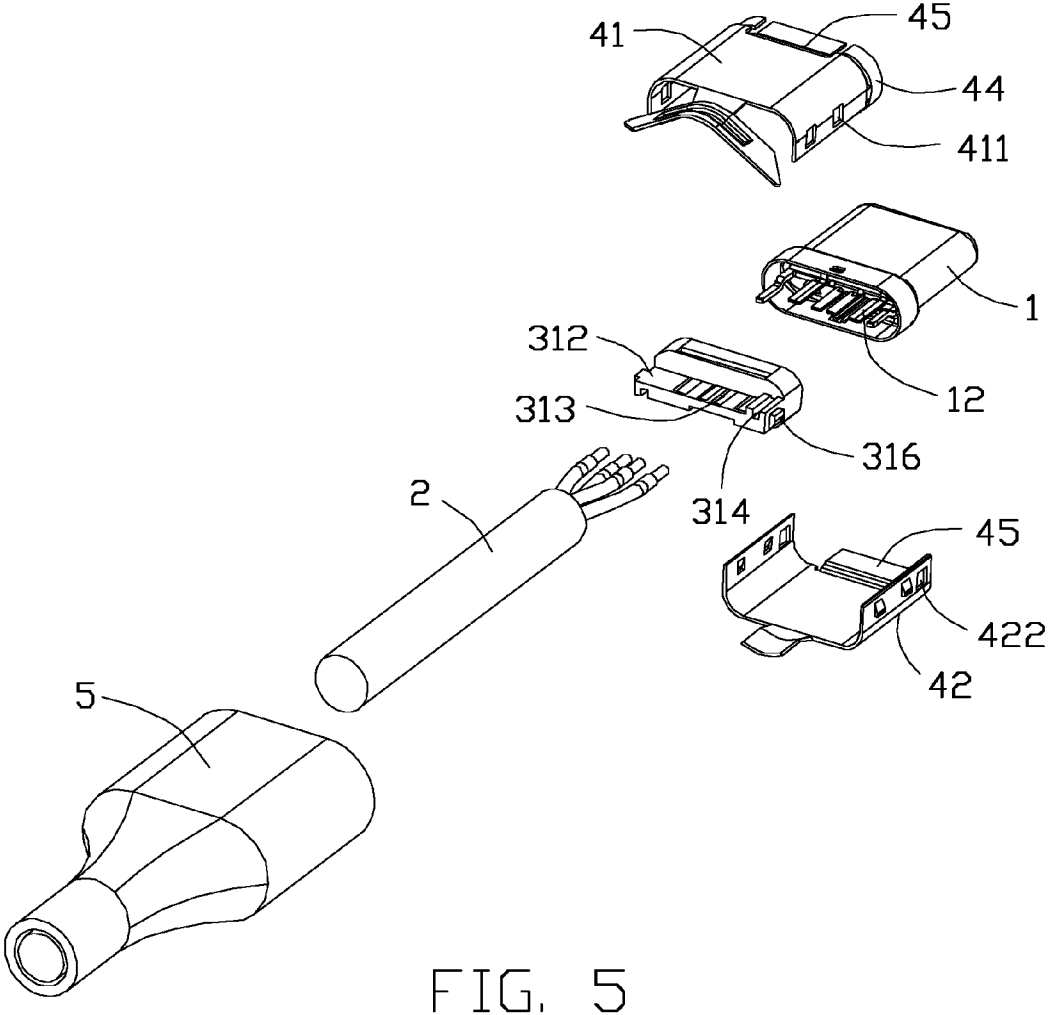
FIG. 5 is an exploded perspective view of the cable connector assembly as shown in FIG. 4 but from a different perspective.

Reference will now be made to the drawing figures to describe a preferred embodiment of the present invention in detail. Referring to FIG. 1 and FIG. 5, a cable connector assembly 100 in accordance with the present invention for mating with a mating connector (not shown) includes a plug portion 1, a cable 2 electrically connected to the plug portion 1 and having a plurality of core wires 21, an insulative member 3 mounted on the rear side of the plug portion 1, a metal shell receiving the insulative member 3 and an insulative shell 5 integrally molded in the outside of the metal shell 4. The cable connector assembly 100 can be mated with the mating connector in two different directions to achieve the same function.

Figure 6:
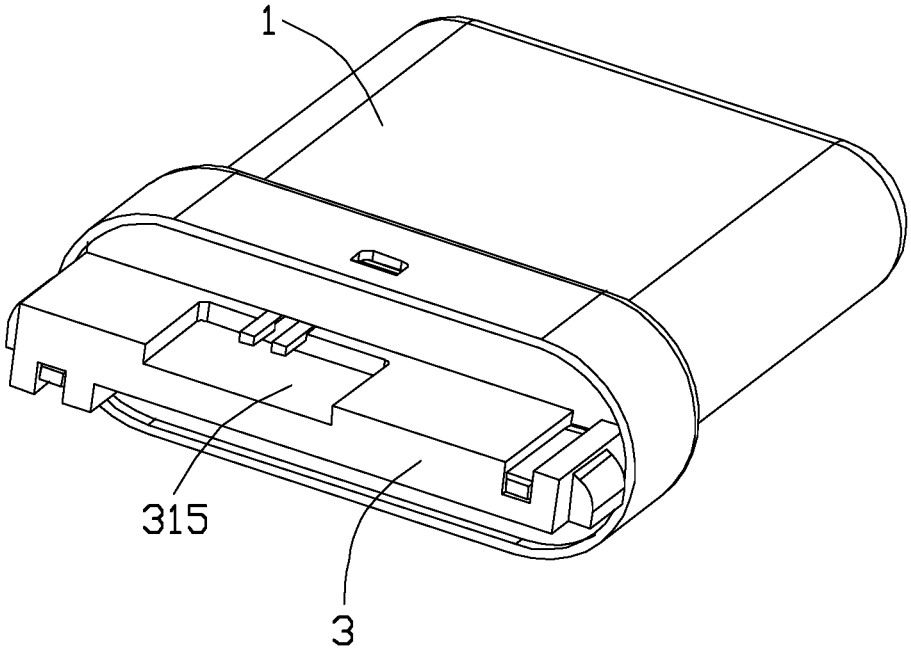
FIG. 6 is a perspective view of partly members of the cable connector assembly as shown in FIG. 1.
Figure 9:
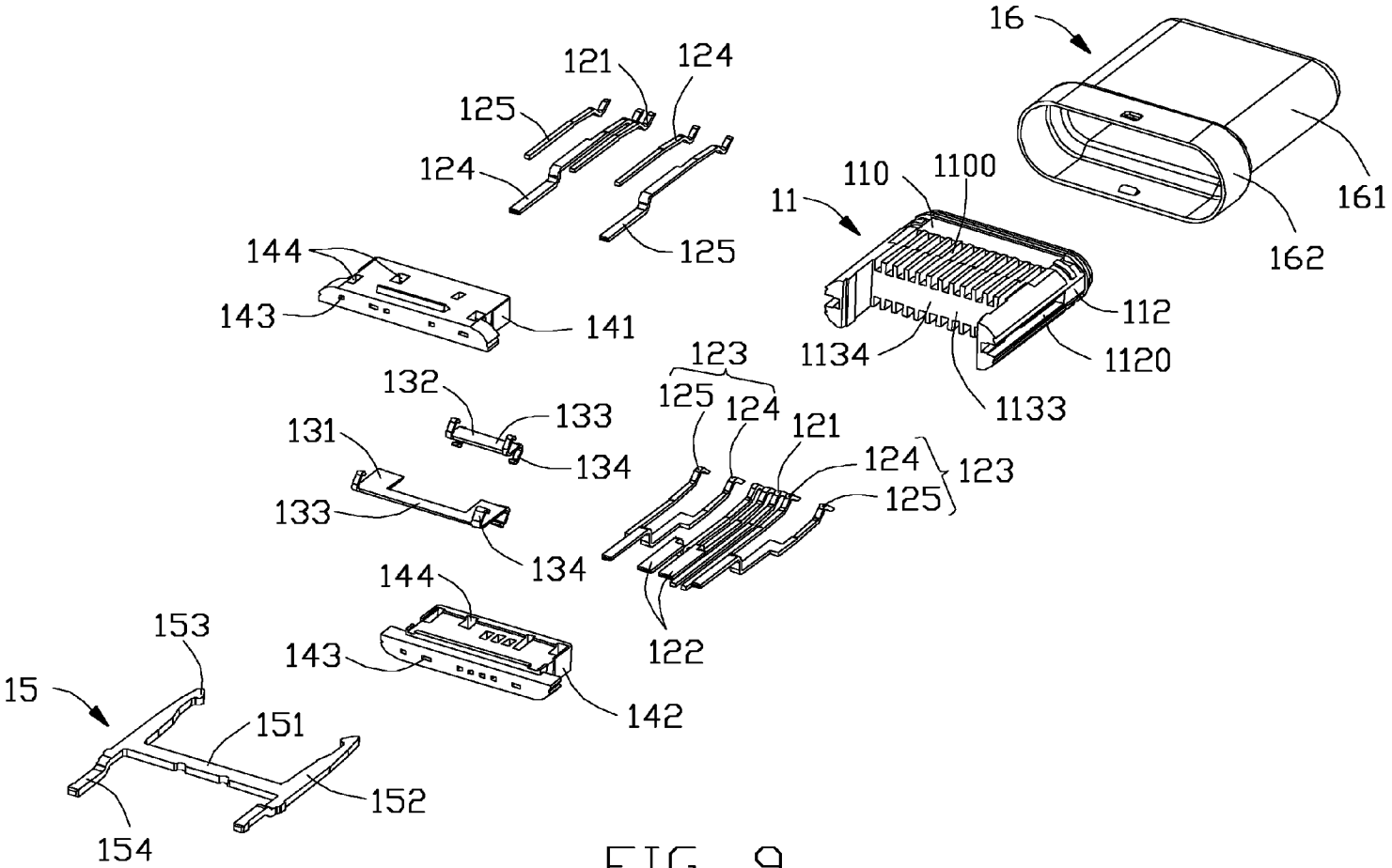
FIG. 9 is an exploded perspective view of the plug portion of the cable connector assembly as shown in FIG. 8.
Figure 10:
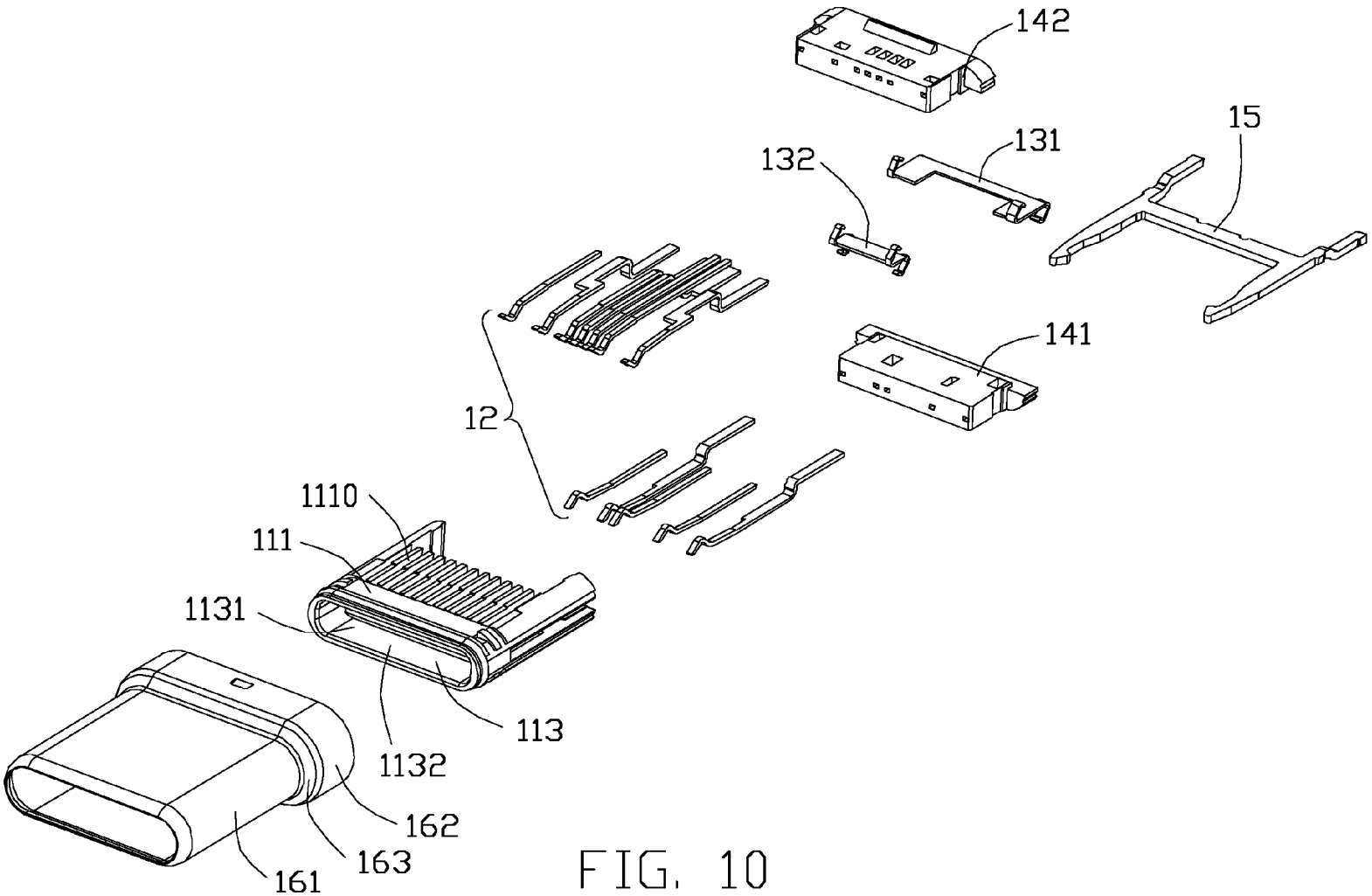
FIG. 10 is an exploded perspective view of the plug portion of the cable connector assembly as shown in FIG. 8 but from a different perspective.

Referring to FIG. 6 and FIG. 9, the plug portion 1 includes an insulative housing 11, a plurality of conductive terminals 12 received in the insulative housing 11 and arranged in two rows spaced apart from each other in a vertical direction, a connecting member or piece 13 making a part of conductive terminals 12 shorted, a retaining member or insulator 14 holding the conductive terminals 12, a latch 15 disposed between the two rows of conductive terminals 12 for latching with the mating connector and a mating shell 16 disposed outside of the insulative housing 11.

The insulative housing 11 includes a top wall 110, a bottom wall 111 spaced apart from and parallel with the top wall 110, a pair of side walls 112 connecting the top wall 110 and the bottom wall 111, and a receiving space 113 surround by the top, bottom, and side walls. The receiving space 113 is divided into a front portion 1132 having a front opening 1131, and a rear portion 1134 having a rear opening 1133. The top wall 110 defines a top slot 1100 in communication with the front portion 1132. The bottom wall 111 defines a bottom slot 1110 in communication with the front portion 1132. Each of the side walls 112 defines a side slot 1120 extending forwardly from a rear end of the insulative housing 11 but not through a front end of the insulative housing 11. The side slots 1120 are in communication with the front portion 1132 and the rear portion 1134 of the receiving space 113.

Figure 11:
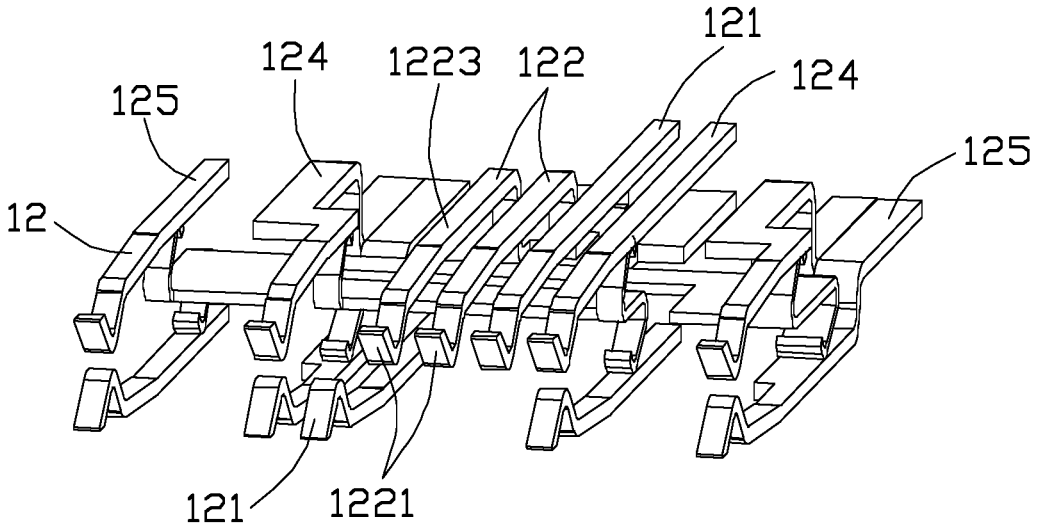
FIG. 11 is a perspective view of partly members of the plug portion as shown in FIG. 1.
Figure 13:
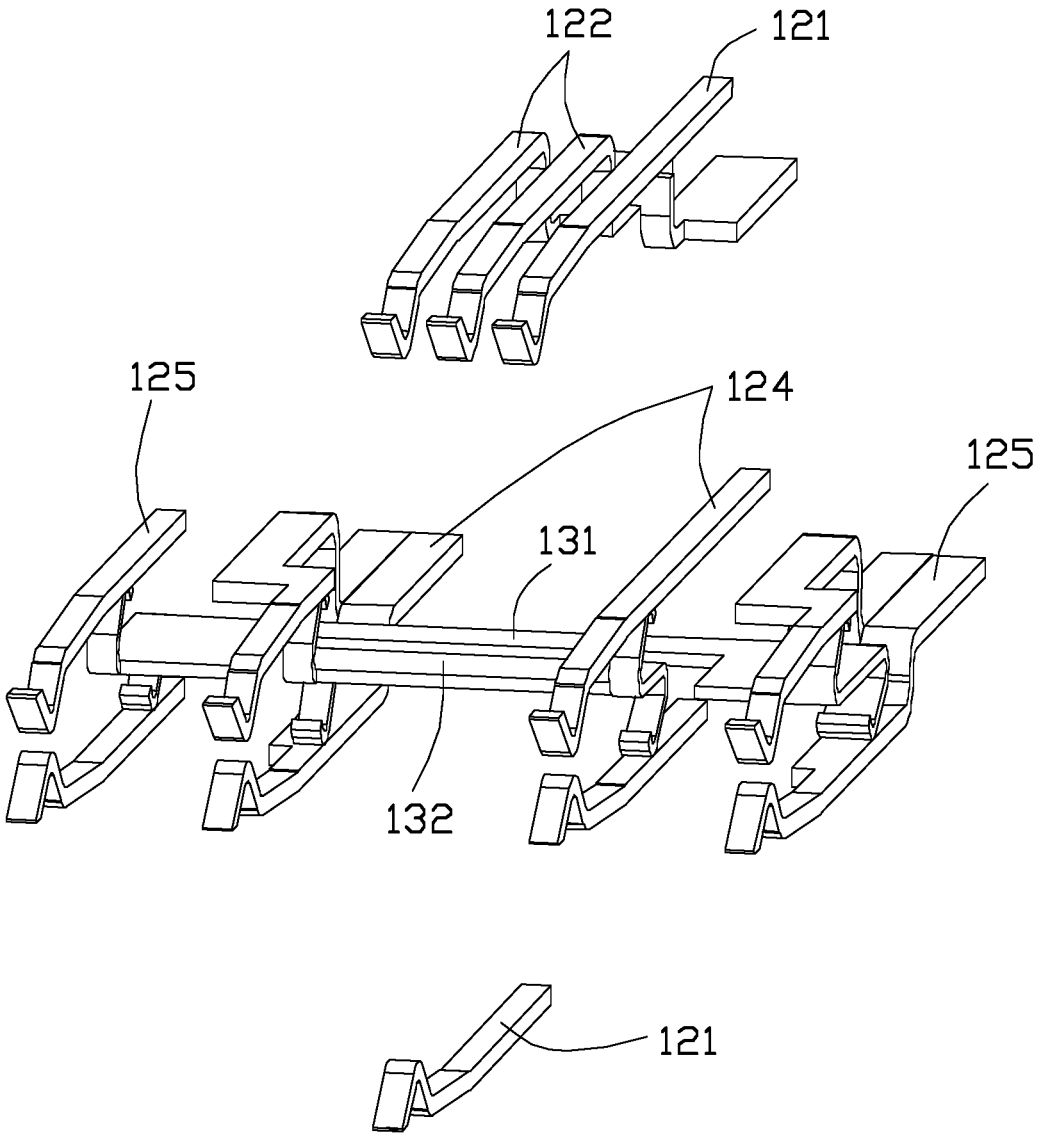
FIG. 13 is an exploded perspective view of partly members of the plug portion as shown in FIG. 11.

Referring to FIG. 11 and FIG. 13, the conductive terminals 12 are arranged in two rows and include a plurality of detecting terminals 121, a plurality of signal terminals 122 and a plurality of first terminals 123. The first terminals 123 include a plurality of power terminals 124 and a plurality of grounding terminals 125. Each first terminal 123 defines a first contacting portion 1231, a first soldering portion 1232 and a first connecting portion 1233 connecting with the first contacting portion 1231 and the first soldering portion 1232, the first contacting portions 1231 of the first terminals 123 in two rows are disposed opposite in the vertical direction. Each signal terminal 122 defines a second contacting portion 1221, a second soldering portion 1222 and a second connecting portion 1223 connecting with the second contacting portion 1221 and the second soldering portion 1222, the second contacting portions 1221 of the signal terminals 122 in two rows are disposed opposite in the vertical direction. The first soldering portions 1232 of the first terminals 123 and the second soldering portions 1222 of the signal terminals 122 are bent and located in a first plane so that the cable 2 can be welded on the soldering portions.

Figure 12:
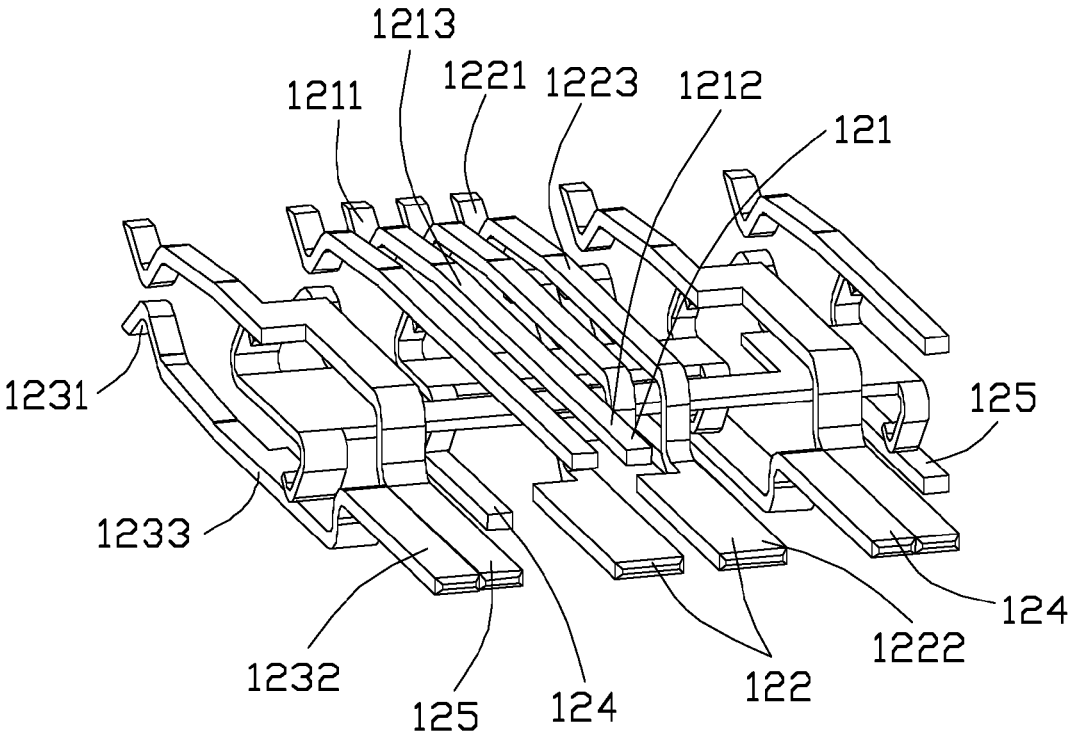
FIG. 12 is another perspective view of partly members of the plug portion as shown in FIG. 11.

There are four grounding terminals 125 disposed symmetrically in the vertical direction and located in both sides of the conductive terminals 12 in a transverse direction perpendicular to the vertical direction, wherein the first soldering portions 1232 of a pair of symmetrical grounding terminals 125 are bent to the first plane and soldered with a common core wire 21. There are four power terminals 124 disposed symmetrically in the vertical direction and located between the grounding terminals 125 in the transverse direction, wherein the first soldering portions 1232 of a pair of symmetrical power terminals 124 are bent to the first plane and soldered with a common core wire 21, thus increasing the welding area of the soldering portions. Each detecting terminal 121 defines a third contacting portion 1211, a third soldering portion 1212 and a third connecting portion 1213 connecting with the third contacting portion 1211 and the third soldering portion 1212, the third contacting portions 1211 of the detecting terminals 121 in two rows are disposed opposite in the vertical direction, and the first soldering portion 1232 of one power terminal 124 and the third soldering portion 1213 of one detecting terminal 121 are extending to a second plane for welding resistance. After welding resistance, when the cable connector assembly 100 is inserted into the mating connector (not shown), the power terminals 124 are turned on so that the voltage increases, and the detecting terminals 121 detect signals such that the cable connector assembly 100 starts to work. Referring to FIG. 12, the conductive terminals 12 are arranged in two rows, the first row has seven conductive terminals 12 and the second row has five conductive terminals 12. The conductive terminals 12 in the first row are used as a grounding terminal 125, a power terminal 124, a detecting terminal 121, a pair of signal terminal 122, a power terminal 124 and grounding terminal 125 from left to right, and the conductive terminals 12 in the second row are usi as a grounding terminal 125, a power terminal 124, a detecting terminal 121, a power terminal 124 and a grounding terminal 125 from left to right. The detection terminal 121 in the second row is vacant and not connecting the core wire 21.

The connecting member 13 is disposed between two rows of conductive terminals 12 and includes a first connecting member 131 for the grounding terminals 125 shorted together and a second connecting member 132 for the power terminals 124 shorted together, the grounding terminals 125 are shorted together by the first connecting member 131 and soldered with a common core wire 21, and the power terminals 124 are shorted together by the second connecting member 132 and soldered with another common core wire 21. The connecting member 13 defines a plate portion 133 and a plurality of tabs 134 bent and extending from the plate portion 133, the first terminals 123 are shorted together by the tabs 134. The tabs 134 are symmetrically disposed on the both sides of the plate portion 133, the distance between the top of each pair of the tabs 134 is greater than the distance between the adjacent conductive terminals 12 so that the connecting member 13 sufficient contacts with the conductive terminals 12.

The retaining member 14 includes a first retaining member 141 for retaining the conductive terminals 12 in the first row and a second retaining member 142 for retaining the conductive terminals 12 in the second row, and the connecting member 13 is located between the first retaining member 141 and the second retaining member 142. The retaining member 14 defines a plurality of terminal slots 143 running through the retaining member 14 in a mating direction perpendicular to the transverse direction and the vertical direction for receiving the conductive terminals 12 and a plurality of mounting holes 144 recessed from the surface of the retaining member 14 in the vertical direction, the mounting holes 144 are communicating with the terminal slots 143 and the tabs 134 are connected to the first terminals 123 by the mounting holes 144.

The latch 15 includes a base portion 151 extending along the transverse direction, a pair of latch beams 152 respectively extending forwardly from two opposite ends of the base portion 151, a pair of latch portions 153 extending from front end of the latch beams 152 along a face to face direction and a pair of extending beams 154 respectively extending rearwardly from two opposite ends of the base portion 151. One of the extending beams 154 is located above the plane of the base portion 151 and the other is located below the plane of the base portion 151. The latch 15 is mounted into the insulative housing 11 through the rear opening 1133 of the rear portion 1134 of the receiving space 113. The latch beams 152 are received into the side slots 1120, respectively. At least a portion of each of the latch portions 153 projects into the front portion 1132 of the receiving space 113. The pair of latch portions 153 are arranged face to face along the transverse direction.

The mating shell 16 has a closed circumference that has a good seal performance, a good anti-EMI performance, etc. The closed circumference of the mating shell 16 could be manufactured by drawing a metal piece, bending a metal piece, die casting, etc. The mating shell 16 includes a front end portion 161 for being inserted into the mating connector, a rear end portion 162 larger than the front end portion 161, and an intermediate portion 163 for connecting the front end portion 161 and the rear end portion 162. A diametrical dimension of the front end portion 161 is smaller than the diametrical dimension of the rear end portion 162.

Figure 4:
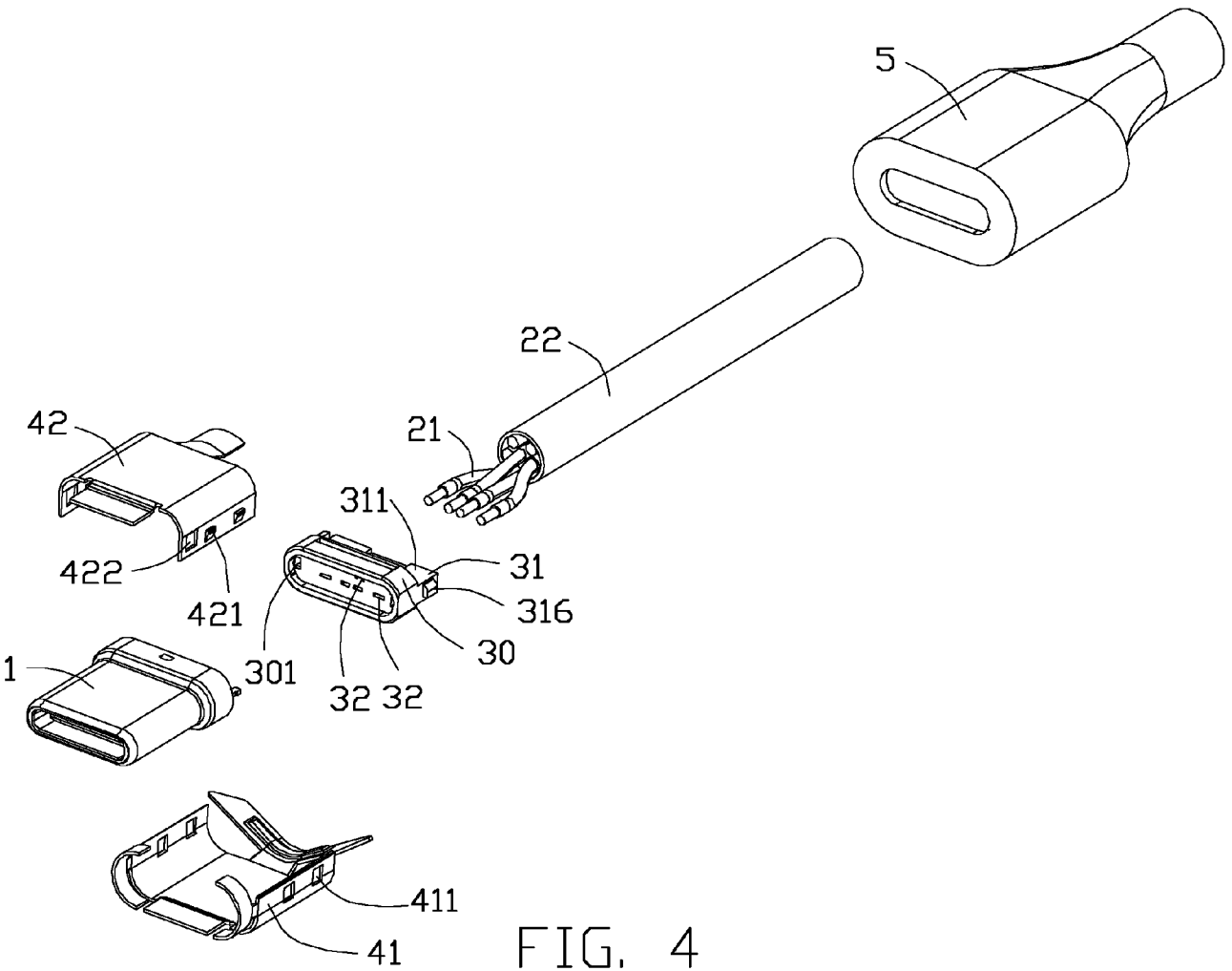
FIG. 4 is an exploded perspective view of the cable connector assembly as shown in FIG. 1.
Figure 7:
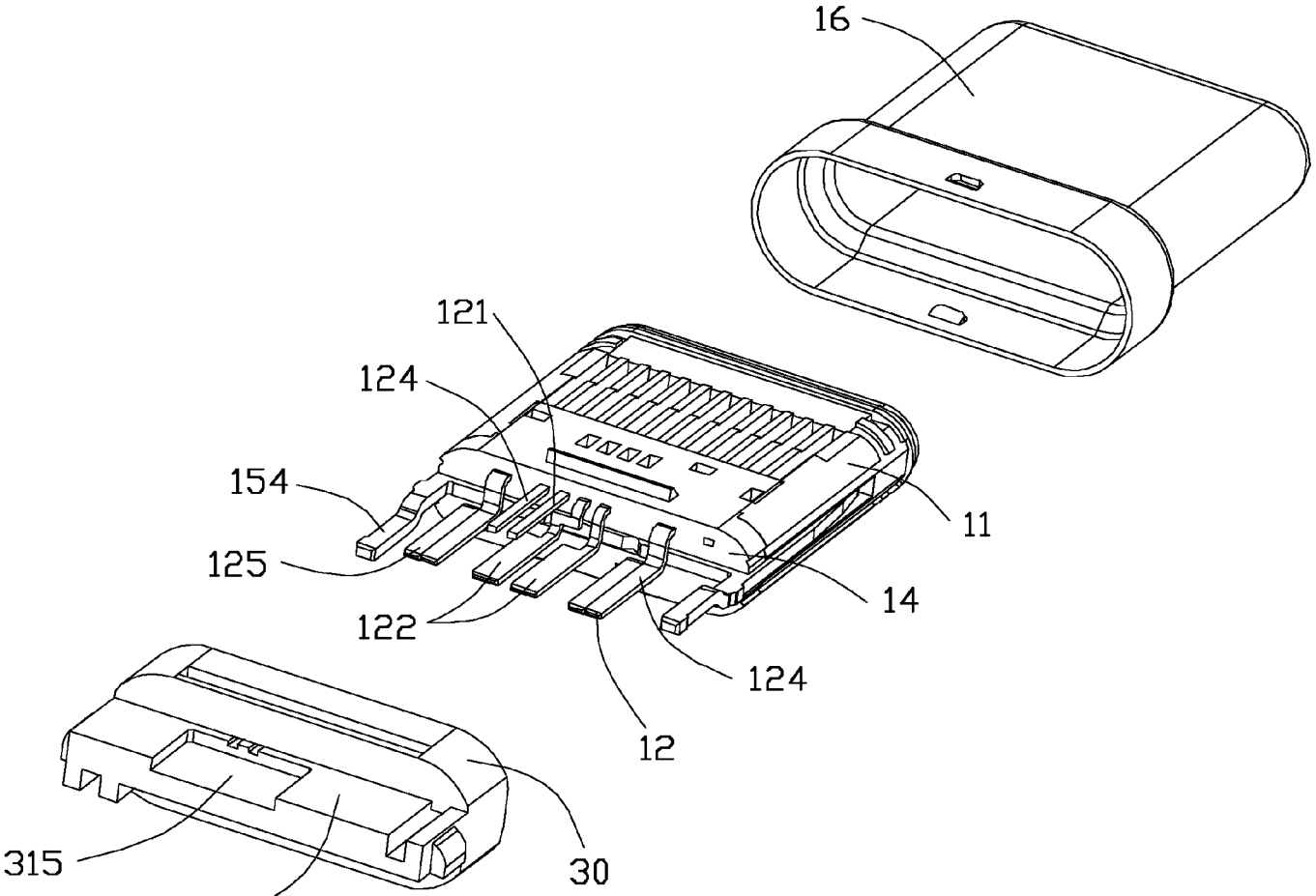
FIG. 7 is a partially exploded view of partly members of the cable connector assembly as shown in FIG. 6.
Figure 8:
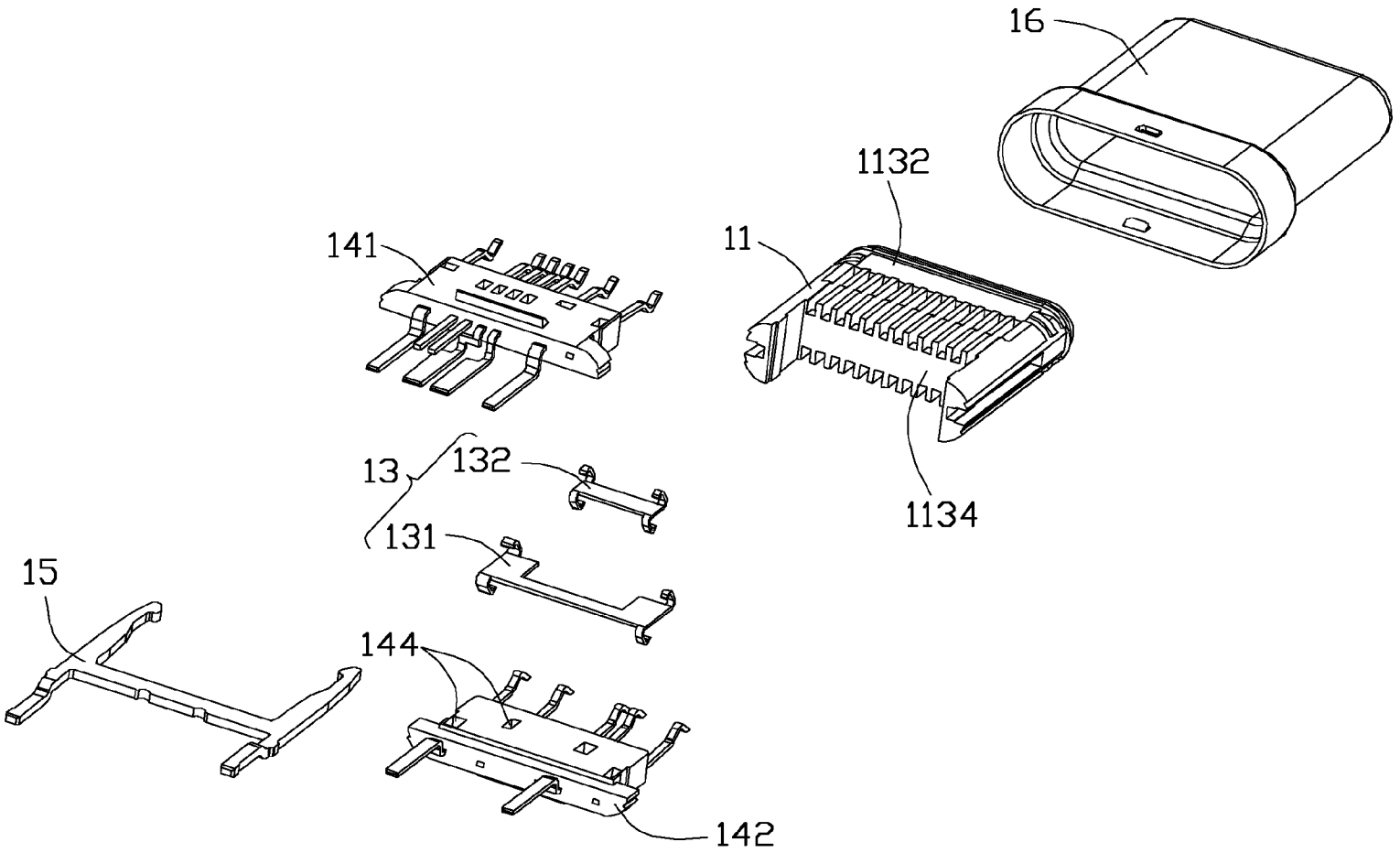
FIG. 8 is a partially exploded view of a plug portion of the cable connector assembly as shown in FIG. 1.

Referring to FIG. 4 and FIG. 7, the insulative member 3 cooperates with the insulative housing 11 to fix the latch 15. The insulative member 3 includes an insulative base portion 30, an extending portions 31 extending rearwardly from the insulative base portion 30, two rows of through holes 32 spaced apart in the vertical direction and extending through the insulative base portion 30 along the mating direction, and a pair of mounting slots 301 located on both sides of the insulative base portion 30 in the transverse direction. The shape of the rear end portion 162 of the mating shell 16 is corresponding to the shape of the insulative base portion 30 of the insulative member 3, the insulative member 3 is assembled to the insulative housing 11 along a rear-to-front direction, the conductive terminals 12 are inserted to the corresponding through holes 32, and the pair of the extending portions 154 of the latch 15 are extending into the corresponding mounting slots 301. The extending portion 31 of the insulative member 3 defines an upper surface 311 and a lower surface 312 corresponding to the upper surface 311, the upper surface 311 defines a plurality of retaining slots 313 for receiving the soldering portions of the conductive terminals 12 and a latch slot 314 for locking the corresponding extending beam 154 of the latch 15, and the lower surface 312 defines a receiving slot 315. The soldering portions of the conductive terminals 12 are extending outside of the insulative base portion 30 and located within the retaining slots 313 of the extending portion 31 so as to electrically connect to the cable 2. The extending beams 154 of the latch 15 of the plug portion 1 are extending outside of the mounting slots 301 and disposed on the upper surface 311 and the lower surface 312 of the insulative member 3. The extending portion 31 of the insulative member 3 defines a pair of projections 316 disposed on both sides thereof.

The cable 2 includes a plurality of core wires 21 and an insulative layer 22 covering the core wires 21. The core wires 21 are electrically connecting to and fixed to the corresponding soldering portions of the conductive terminals 12.

Figure 2:
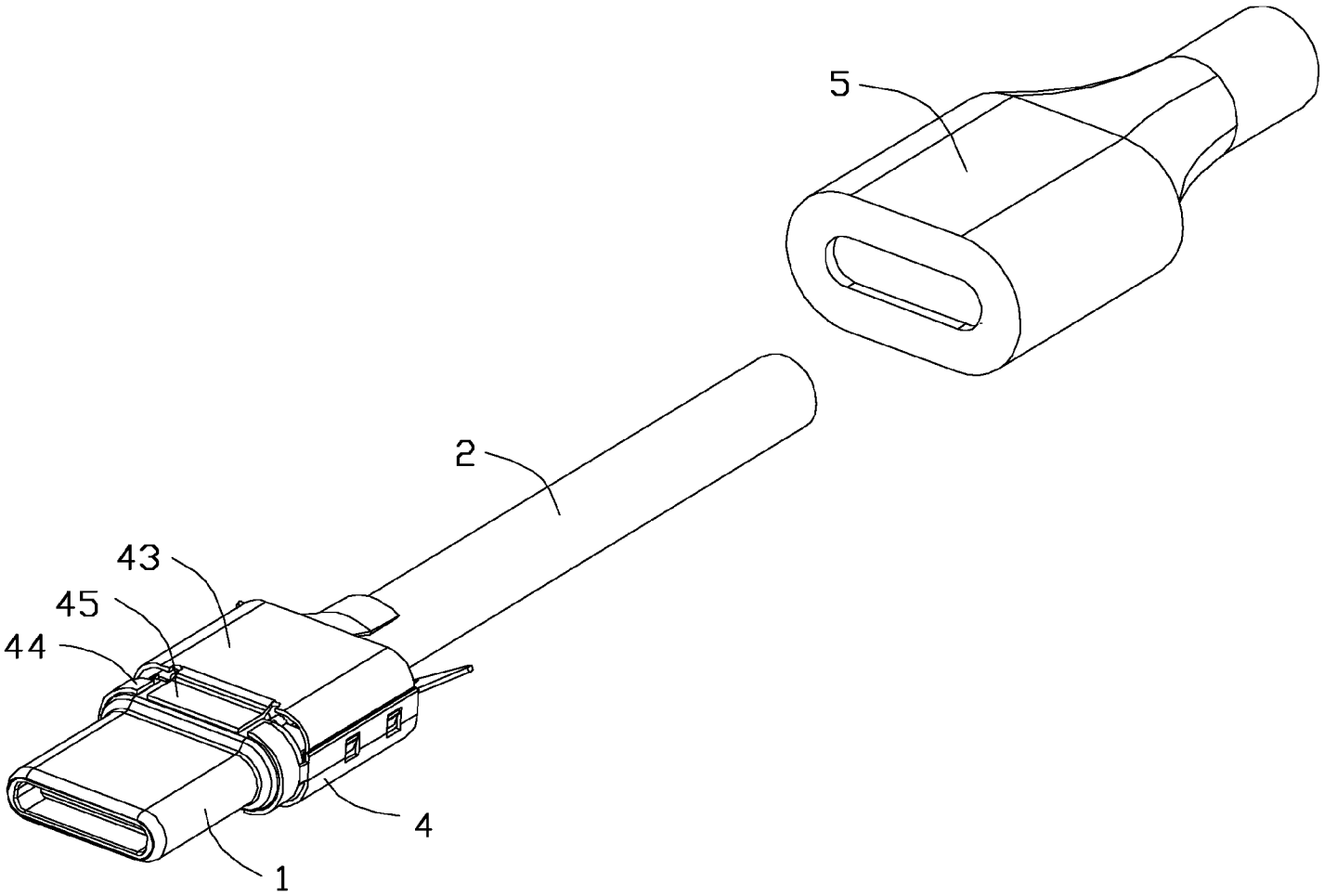
FIG. 2 is a partially exploded view of the cable connector assembly shown as in FIG. 1.
Figure 3:
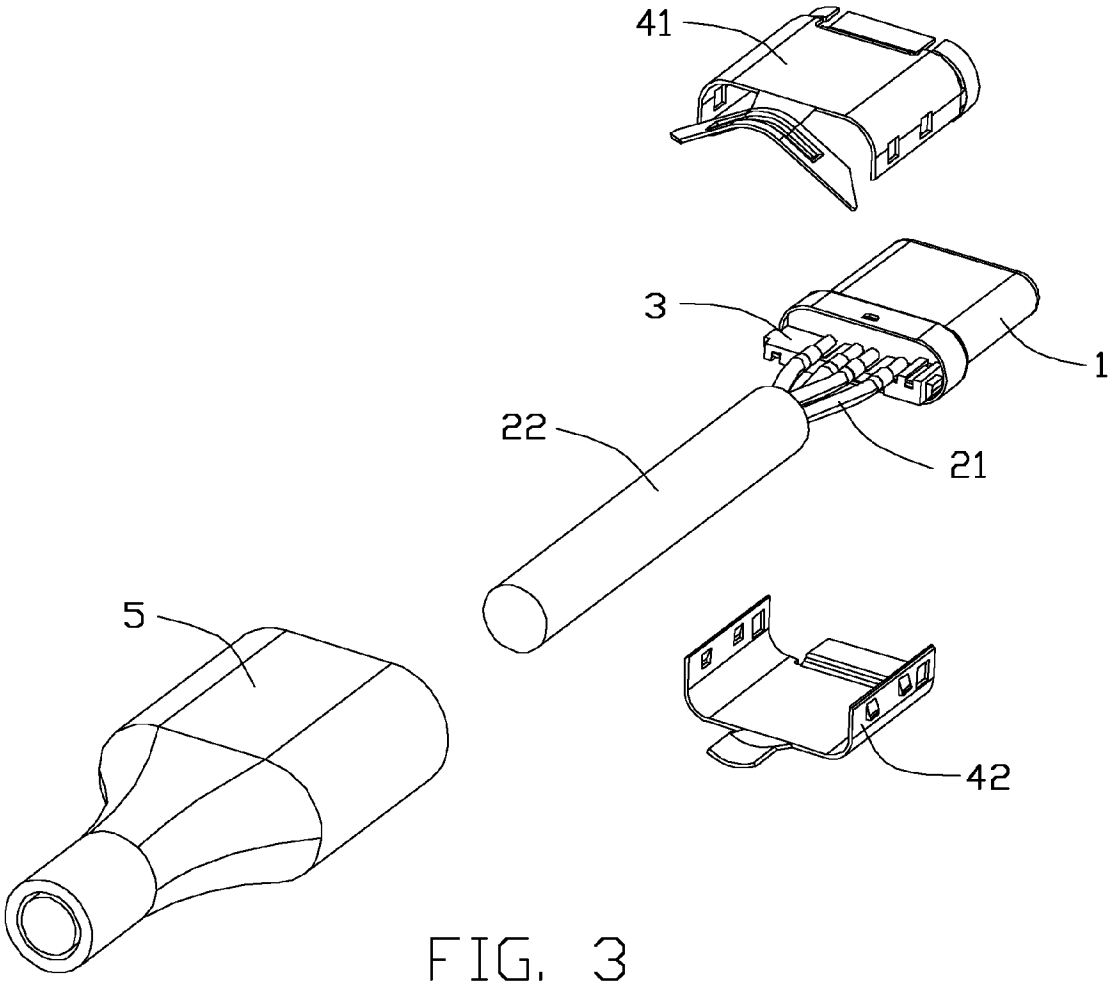
FIG. 3 is another partially exploded view of the cable connector assembly as shown in FIG. 1.

Referring particularly to FIG. 2 and FIG. 5, the metal shell 4 includes a first shell 41 and a second shell 42 mating with each other, the first shell 41 and the second shell 42 are assembled together to define a main portion 43 and a pair of clamping portions 44 extending forwardly from both sides of the main portion 43. In this embodiment, the clamping portions 44 are fixed to the rear end portion 162 by soldering, in other embodiments, the clamping portions 44 can be fixed to the rear end portion 162 by gluing or other manners. The clamping portions 44 are disposed on the first shell 41, each of the first shell 41 and the second shell 42 defines a tongue portion 45 extending forwardly from the main portion 43 and disposed between the clamping portions 44 in the transverse direction, and the tongue portions 45 are clamping the rear end portion 162 and fixed to the rear end portion 162 by soldering. The first shell 41 defines a plurality of latch holes 411 disposed on both sides thereof and the second shell 42 defines a plurality of latch tabs 421 disposed on both sides thereof, the first shell 41 is fixed to the second shell 42 by the latch tabs 421 being retained in the corresponding latch holes 411. The second shell 42 further defines a pair of retaining holes 422 used for receiving the projections 316 of the insulative member 3. The metal shell 4 is fixed to the insulative member 3 by the projections 316 being retained in the corresponding retaining holes 422.

The assembling process of the cable connector assembly 100 is as follows, firstly the retaining member 14 is injection molded and retaining the conductive terminals 12, the retaining member 14 defines a first retaining member 141 for retaining the conductive terminals 12 in the first row and a second retaining member 142 for retaining the conductive terminals 12 in the second row, and the conductive terminals 12 are received in the terminal slots 143 of the retaining member 14. Then the first retaining member 141 and the conductive terminals 12 in first row are assembled to the insulative housing 11, and the first connecting member 131 and the second connecting member 132 are mounted in the first retaining member 141, wherein the tabs 134 of the connecting member 13 are inserted into the mounting holes 144 so that the tabs 134 can touch the first terminals 123. The second retaining member 142 and the conductive terminals 12 in second row are assembled to the insulative housing 11 so that the connecting member 13 is retained between the first retaining member 141 and the second retaining member 142, wherein the tabs 134 of the connecting member 13 are also inserted into the mounting holes 144 of the second retaining member 142 so that the four grounding terminals are shorted and the four power terminals are shorted.

The latch 15 is mounted into the insulative housing 11 and the insulative housing 11 is mounted into the mating shell 16. Then the insulative member 3 is inserted into the rear end portion 162 of the mating shell 16, wherein the soldering portions of the first terminals 123 and the signal terminals 122 are passing through the through holes 32 of the insulative member 3 and received in the retaining slots 313 of the insulative member 3. The first soldering portion 1231 of a power terminal 124 and the third soldering portion 1212 of a detecting terminal 121 are passing through the through holes 32 and located in the receiving portion 315 for welding resistance. The extending beams 154 of the latch 15 are extending outside of the mounting slots 301 and located on the corresponding latch slots 314 of the upper surface 311 and the lower surface 312 of the insulative member 3, and the extending beams 154 can be fixed by soldering or gluing. Then the core wires 21 of the cable 2 are welding to the corresponding first soldering portion 1232 or the second soldering portion 1222.

The metal shell 4 includes a first shell 41 and a second shell 42 mating with each other, the first shell 41 is covering the plug portion 1 and the insulative member 3 until the clamping portions 44 are clamping the rear end portion 162 of the mating shell 16. The second shell 42 is fixed to the first shell 41 along the vertical direction by the latch tabs 421 being retained in the corresponding latch holes 411. The second shell 42 further defines a pair of retaining holes 422 used for receiving the projections 316 of the insulative member 3, the clamping portions 44 and the tongue portions 45 are fixed to the rear end portion 162 of the mating shell 16 by soldering. The insulative shell 5 is covering the outside of the metal shell 4. Thus, the assembly of the cable connector assembly 100 is completed. However, the assembly sequence of the cable connector assembly 100 is not unique, the maker can make adaptations as needed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A cable connector assembly, comprising:

a plug portion defining an insulative housing and a plurality of conductive terminals received in the insulative housing and arranged in two rows spaced apart from each other in a vertical direction, the conductive terminals including a plurality of detecting terminals, a plurality of signal terminals and a plurality of first terminals; and a cable electrically connected with the plug portion and having a plurality of core wires; and an insulative shell covering a part of the plug portion and the cable; wherein the plug portion further includes a connecting member for the first terminals shorted, the connecting member makes the first terminals shorted together so as to the first terminals are just soldered with a core wire of the cable;

wherein the first terminals include a plurality of power terminals and a plurality of grounding terminals, the connecting member includes a first connecting member for the grounding terminals shorted together and a second connecting member for the power terminals shorted together so that the grounding terminals are shorted together by the first connecting member and soldered with a core wire and the power terminals are shorted together by the second connecting member and soldered with another core wire; wherein the connecting member defines a plate portion and a plurality of tabs bent and extending from the plate portion, the first terminals are shorted together by the tabs; wherein the plug portion includes a retaining member holding the conductive terminals, the retaining member defines a first retaining member for retaining the conductive terminals in the first row and a second retaining member for retaining the conductive terminals in the second row, and the connecting member is located between the first retaining member and the second retaining member; wherein the retaining member defines a plurality of terminal slots running through the retaining member in a mating direction perpendicular to the vertical direction for receiving the conductive terminals and a plurality of mounting holes recessed from the surface of the retaining member in the vertical direction, the mounting holes are communicating with the terminal slots and the tabs are connected to the first terminals by the mounting holes.

2. The cable connector assembly as described in claim 1, wherein each first terminal defines a first contacting portion, a first soldering portion and a first connecting portion connecting with the first contacting portion and the first soldering portion, each signal terminal defines a second contacting portion, a second soldering portion and a second connecting portion connecting with the second contacting portion and the second soldering portion, the first soldering portions and the second soldering portions are bent and located in a first plane so that the cable can be welded on the soldering portions.

3. The cable connector assembly as described in claim 2, wherein there are four grounding terminals disposed symmetrically in the vertical direction and located in both sides of the conductive terminals in a transverse direction perpendicular to the vertical direction, and the first soldering portions of a pair of symmetrical grounding terminals are bent to the first plane and soldered with a common core wire.

4. The cable connector assembly as described in claim 2, wherein there are four power terminals disposed symmetrically in the vertical direction and located between the grounding terminals in a transverse direction, and the first soldering portions of a pair of symmetrical power terminals are bent to the first plane and soldered with a common core wire.

5. The cable connector assembly as described in claim 2, wherein the each detecting terminal defines a third contacting portion, a third soldering portion and a third connecting portion connecting with the third contacting portion and the third soldering portion, and the first soldering portion of one power terminal and the third soldering portion of one detecting terminal are extending to a second plane for welding resistance.

6. A method of manufacturing cable connector assembly, comprising the steps of:

providing a plurality of conductive terminals arranged in two rows spaced apart from each other in a vertical direction;

insert molding a retaining member to retain the conductive terminals, the retaining member defining a first retaining member for retaining the conductive terminals in the first row and a second retaining member for retaining the conductive terminals in the second row;

providing an insulative housing, and making the first retaining member and the conductive terminals in first row assembled to the insulative housing;

providing a connecting member, making the connecting member mounted in the first retaining member, and making the second retaining member and the conductive terminals in second row assembled to the insulative housing so that the connecting member is retained between the first retaining member and the second retaining member, the connecting member making a part of conductive terminals shorted;

providing a mating shell covering the insulative housing;

wherein the part of conductive terminals include a plurality of power terminals and a plurality of grounding terminals, the connecting member includes a first connecting member for the grounding terminals shorted together and a second connecting member for the power terminals shorted together so that the grounding terminals are shorted together by the first connecting member and soldered with a core wire and the power terminals are shorted together by the second connecting member and soldered with another core wire.

7. An electrical connector comprising:

an insulative housing defining upper and lower passageways spaced from each other in a vertical direction, each of said upper passageways and said lower passageways extending through the housing in a front-to-back direction perpendicular to said vertical direction;

an upper terminal module including a plurality of resilient upper contacts insert-molded within an upper insulator, said upper contacts including two opposite upper grounding contacts and two opposite upper power contacts;

a lower terminal module including a plurality of resilient lower contacts insert-molded within a lower insulator, said lower contacts including two opposite lower grounding contacts and two opposite lower power contacts;

a first one of said upper grounding contacts and a neighboring first one of said lower grounding contacts forming two soldering sections side by side intimately arranged with each other in a coplanar manner for soldering to a corresponding wire while a second one of said upper grounding contacts and a neighboring second one of said lower grounding contacts forming no soldering section but electrically connected to said first one of said upper grounding contacts and said another neighboring first one of said lower grounding contacts via a first connecting piece;

wherein a first one of said upper power contacts and a neighboring first one of said lower power contacts forming two soldering sections side by side intimately arranged with each other in a coplanar manner for soldering to another corresponding wire while a second one of said upper power contacts and a neighboring second one of said lower power contacts forming no soldering section but electrically connected to said first one of said upper power contacts and said another neighboring first one of said lower power contacts via a second connecting piece; wherein said second connecting piece is spaced from the first connecting piece in a coplanar manner; wherein the first connecting piece forms a notch to receive a portion of said second connecting piece therein.

8. The electrical connector as claimed in claim 7, wherein said first connecting piece is retained by at least one of said upper insulator and said lower insulator.

9. The electrical connector as claimed in claim 7, wherein the two soldering sections of the upper grounding contact and the lower grounding contact are coplanar with the two soldering sections of the upper power contact and the lower power contact.

10. The electrical connector as claimed in claim 7, wherein the first connecting piece includes four spring tabs respectively contacting the first grounding contact, the second upper grounding contact, the first lower grounding contact and the second lower grounding contact.

11. The electrical connector as claimed in claim 7, further including a metallic latch having a base portion extending in a transverse direction perpendicular to both said vertical direction and said front-to-back direction, wherein said metallic latch is located between the upper terminal module and the lower terminal module, and is not allowed to rearward move due to the side by side arranged two soldering sections of the upper grounding contact and the lower grounding contact.

12. The electrical connector as claimed in claim 7, wherein the upper passageways are exposed upwardly so as to allow the upper terminal module to be downwardly assembled thereto in the vertical direction, and the lower passageways are exposed downwardly so as to allow the lower terminal module to be upwardly assembly thereto in the vertical direction.

* * * * *